US005794463A

United States Patent [19]

McDaid

[11] Patent Number: 5,794,463

[45] Date of Patent: Aug. 18, 1998

[54] TAMPER-PROOF ATTACHMENT FOR CABLE LOCKS AND THE LIKE

[75] Inventor: Cornelius McDaid, Dorchester, Mass.

[73] Assignee: Kryptonite Corporation, Canton, Mass.

[21] Appl. No.: 811,476

[22] Filed: Mar. 4, 1997

[51] Int. Cl.[6] ..... E05B 73/00

[52] U.S. Cl. ..... 70/18; 70/49; 70/58; 70/232; 70/DIG. 57; 248/553; 411/910

[58] Field of Search ..... 70/18, 30, 49, 70/58, 229–232, DIG. 57; 248/500, 551, 552, 553; 411/910, 87

[56] References Cited

U.S. PATENT DOCUMENTS

| | | | |
|---|---|---|---|
| 709,056 | 9/1902 | Smith | 70/DIG. 57 X |
| 1,550,059 | 8/1925 | Clevett | 70/DIG. 57 X |
| 3,625,031 | 12/1971 | Alley, III | 70/DIG. 57 X |
| 3,765,197 | 10/1973 | Foote | 70/DIG. 57 X |
| 3,782,146 | 1/1974 | Franke | 70/232 |
| 3,817,065 | 6/1974 | Sander | 70/232 |
| 3,859,826 | 1/1975 | Singer et al. | 70/58 |
| 3,910,079 | 10/1975 | Gassaway | 70/DIG. 57 X |
| 4,024,740 | 5/1977 | Di Giovanni | 70/DIG. 57 X |
| 4,065,946 | 1/1978 | Loynes et al. | 70/DIG. 57 X |
| 4,444,031 | 4/1984 | Watson | 70/DIG. 57 X |
| 5,351,507 | 10/1994 | Derman | 70/18 |
| 5,406,809 | 4/1995 | Igelmund | 70/18 X |
| 5,447,045 | 9/1995 | Cheng | 70/DIG. 57 X |
| 5,502,989 | 4/1996 | Murray, Jr. et al. | 70/58 |

*Primary Examiner*—Lloyd A. Gall
*Attorney, Agent, or Firm*—Morse & Altman

[57] ABSTRACT

A cable lock attachment for portable articles that is protected from tampering, whether by twisting or otherwise, when the associated cable lock is operational. The attachment comprises a shell with concentric axial ports, one large and one small, and opposed lateral ports. The small port is in proximity to a threaded socket in the article. A collar having a wide head and narrow stem fits through the large port and the stem fits into the small port with the head remaining inside the shell and the stem abutting the article. The stem is secured to the article by a screw that has an internal hex head. The stem is slightly longer than the thickness of the shell so that the shell is free to swivel about the stem when secured. The cable extends through the lateral ports, preventing access to the screw when the cable lock is secured.

15 Claims, 3 Drawing Sheets

TAMPER-PROOF ATTACHMENT FOR CABLE LOCKS AND THE LIKE

BACKGROUND OF THE INVENTION

1. Field of the Invention

The present invention relates to cable locks and the like for securing portable articles to stationary locations and, more particularly, to tamper-proof attachments by which cable locks and the like may serve to secure portable articles to posts, rails, furniture and other relatively immobile stations. Such articles to be secured may be as widely disparate as lap-top computers and snow boards.

2. The Prior Art

Cable locks, as is well known in the art, typically comprise (1) a length of tough flexible cable, and (2) a locking system by which the cable may serve to safely tie an article to an arbitrary location. In the case of bicycles or motorcycles, the locking system may achieve effective security by permitting the cable to be looped in a way that avoids the need for affixing a permanent attachment to the bicycle or motorcycle frame. But, many smaller articles have no structural features like those of a frame. In the case of such smaller articles, affixing a permanent attachment may be necessary. Previously proposed cable attachments have been easily disabled, often merely by twisting the attachment until it is free from threaded engagement with the article that it was intended to secure.

SUMMARY OF THE INVENTION

The primary object of the present invention is the provision of a novel attachment that improves the versatility of cable locks and the like for protection of portable articles from loss or misappropriation. The present invention contemplates a cable-lock attachment that is protected from tampering, whether by twisting or otherwise, when the associated cable lock is operational. Typically, a cable lock includes a flexible cable that is formed of steel strands, and a lock that includes interactive fittings. One of the fittings is affixed to the cable, and the other can be mated to the former in such a way as to secure (1) looped sections of the cable to each other, and/or (2) a terminal or other section of the cable to the attachment.

In a preferred form, the attachment of the present invention is intended for connection to an internally threaded socket that is retained in a sturdy part of the construction of the portable article. The attachment comprises a shell having concentric axial ports and opposed lateral ports. The concentric ports have different diameters, of which the smaller diameter is positioned in proximity to the threaded socket of the article being secured. Within the housing is a collar that is shouldered internally and externally to provide a stem of relatively small internal and external diameter, and a head of relatively large internal and external diameter. The entire collar fits through the larger of the concentric ports. Only its stem fits through the smaller of the concentric ports and into contiguity with the threaded socket in the article being secured. The axial length of the stem is greater than the thickness of the shell in the vicinity of the threaded socket. The shell and the collar are fastened to the article by a screw, which has a threaded shank and an internal hex head. The screw shank is turned into the article's internally threaded socket by a hex wrench. The screw head abuts against the inner shoulder of the collar, and clamps the free extremity of the stem against the region surrounding the socket. The arrangement is such that: the shell is free for swiveling about the collar because of its freedom from the collar's head; the hex notch in the screw head is shielded by the cable when the cable is threaded through the lateral ports in the shell; external access to the stem is denied because of the close proximity of the shell to region surrounding the socket; and swiveling of the shell has no effect on the junction between the attachment and the article because of the shell's freedom to swivel about the stem.

Other objects of the present invention will in part be obvious and will in part appear hereinafter.

BRIEF DESCRIPTION OF THE DRAWINGS

For a fuller understanding of the nature and objects of the present invention, reference is made to the following specification, which is to be taken in connection with the accompanying drawings wherein.

DETAILED DESCRIPTION OF THE PREFERRED EMBODIMENT

Figure 1:
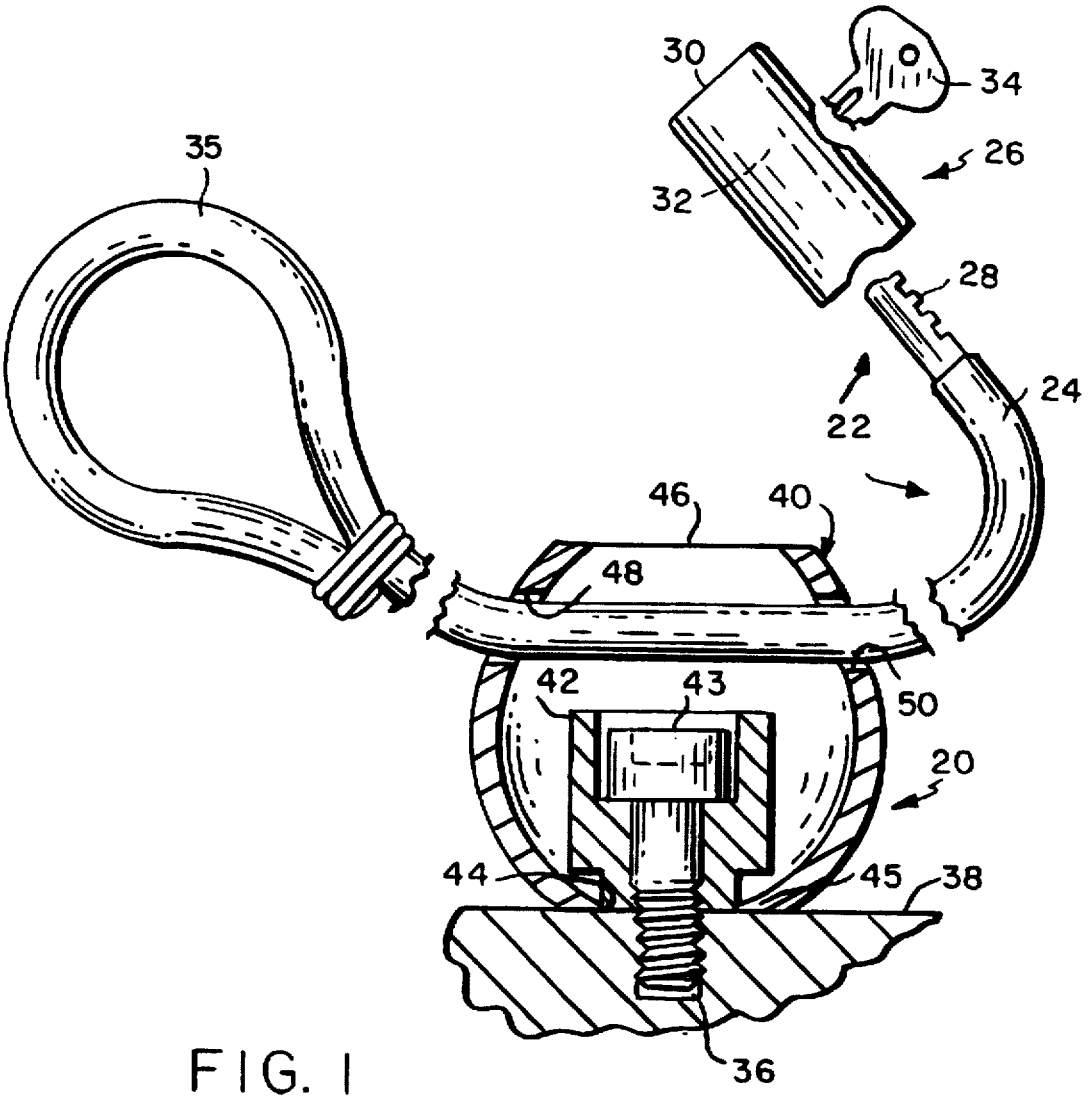
FIG. 1 is an assembly view, partly broken away, of an attachment and cable lock embodying the present invention.
Figure 2:
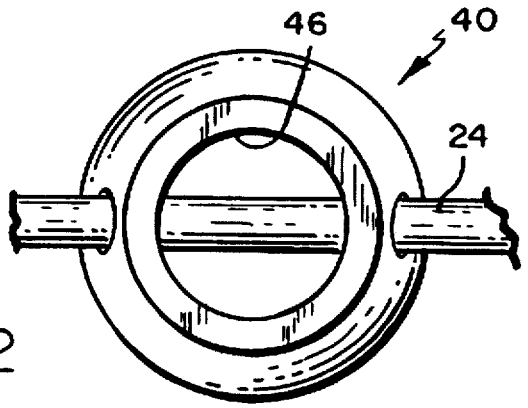
FIG. 2 is a top plan view of the attachment and cable lock, as shown in FIG. 1.
Figure 3:
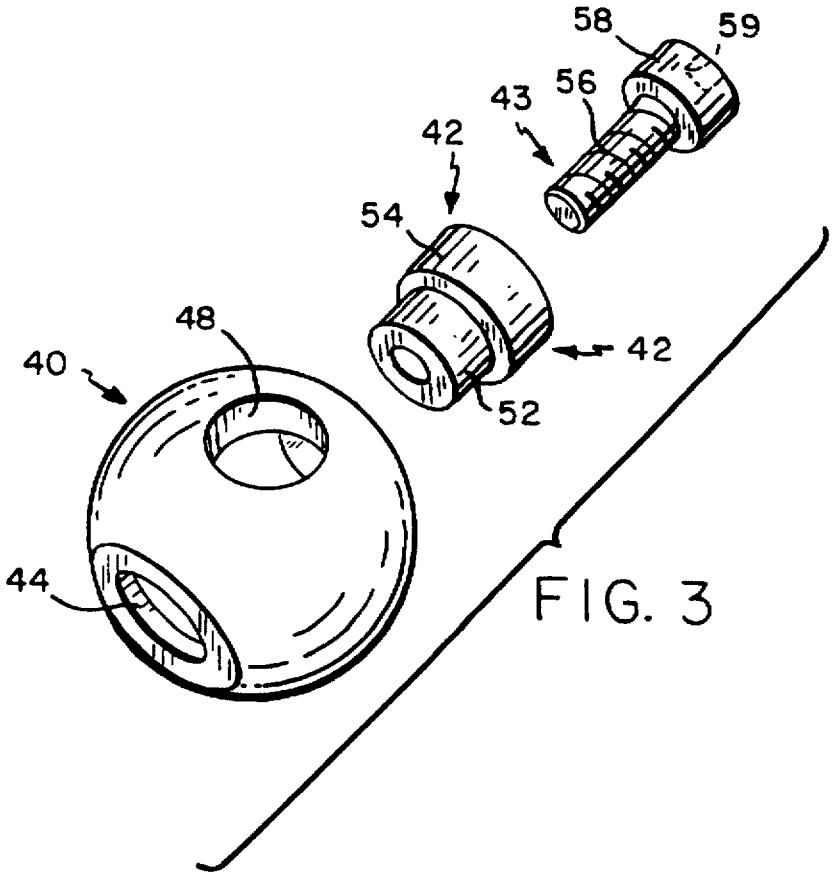
FIG. 3 is an exploded view of the components of the attachment of FIG. 1.
Figure 6:
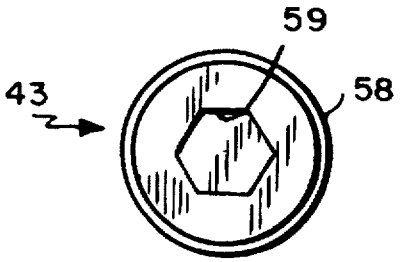
FIG. 6 is a top view of the screw of FIG. 1.

FIG. 1 shows an attachment 20 in association with a cable lock generally shown at 22. Cable lock 22 comprises a flexible cable 24 that is composed of braided steel strands, and a lock 26 that includes a lock bolt 28 and a lock body 30. Lock body 30 includes a key way and associated lock mechanism 32, and a key 34. In the form shown, one end of the cable is in the form of a permanent loop 35, and the other end of the cable is connected to lock bolt 28. Alternatively, the cable may be replaced by a chain or other tether. Ordinarily, the cable or chain is enclosed within a protective plastic sheath. In various alternative embodiments, the lock body and lock bolt take a variety of forms and are fastened to a variety of locations on the cable, chain or other tether.

In a preferred form, attachment 20 is intended for connection to an internally threaded socket 36 that is retained in a sturdy part of the construction of a portable article 38. As shown, the attachment comprises a shell 40, a shouldered collar 42 therewithin, and a screw 43 projecting therethrough and turned into internally threaded socket 36.

Shell 40 has concentric axial ports 44, 46 and opposed lateral ports 48, 50. The concentric ports have different diameters. Concentric port 44, which has a smaller diameter than concentric port 46, is positioned contiguously with threaded socket 36 of article 38. Concentric port 46, which has a larger diameter than concentric port 44, is positioned remotely from threaded socket 36. The lateral ports are disposed along a transverse axis that is closer to larger port 46 than to smaller port 44. Preferably, shell 40 is a spheroid and is composed of hardened steel. It is sturdy enough to withstand all but the most severe deliberate mechanical deformation. The spherical shape means that the inner surface 45 of the shell 40 adjacent to smaller port 44 is curved about the center of the shell 40 and away from threaded socket 36.

Within shell 40, collar 42 is shouldered internally and externally to provide a stem 52 of relatively small internal and external diameter, and a head 54 of relatively large internal and external diameter. The entire collar fits through larger port 46 of shell 40. Stem 52 of collar 42 fits through smaller port 44 of shell 40 and into tight contact with threaded socket 36. The transverse diameter of head 54 is larger than the diameter of smaller port 44 of the shell. The axial length of the stem is greater than the thickness of the shell in its vicinity. The arrangement is such that shell 40 can be swiveled freely about stem 52 when stem 52 is in tight contact with threaded socket 36. Preferably, collar 42 is composed of hardened steel. It is sturdy enough to withstand all but the most severe deliberate mechanical deformation.

Screw 43, which fastens the shell and the collar to article 38, has a threaded shank 56 and a head 58 with an internal hex notch 59. Screw shank 56 is turned into internally threaded socket 36. Screw head 58 abuts tightly against collar head 54 and clamps the free extremity of collar stem 52 against the region surrounding socket 36. Preferably, screw 43 is composed of hardened steel. It is sturdy enough to withstand all but the most severe deliberate mechanical deformation of the attachment.

OPERATION

Figure 4:
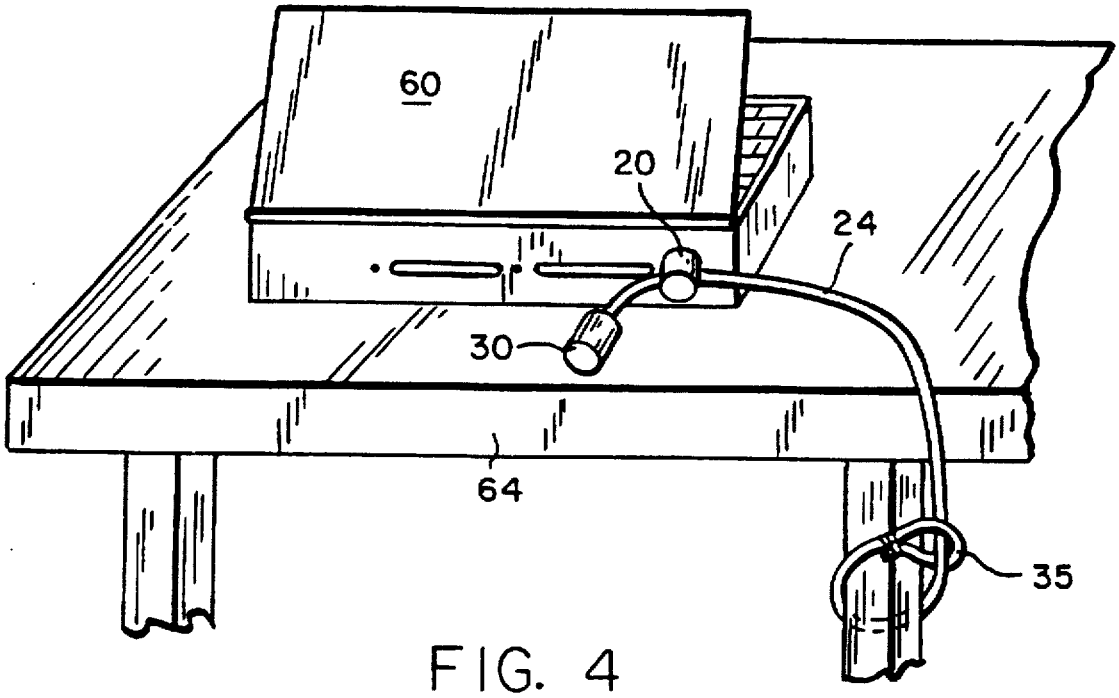
FIG. 4 is a perspective view of a cable lock and attachment assemblage securing a lap top computer to a table in accordance with the present invention.
Figure 5:
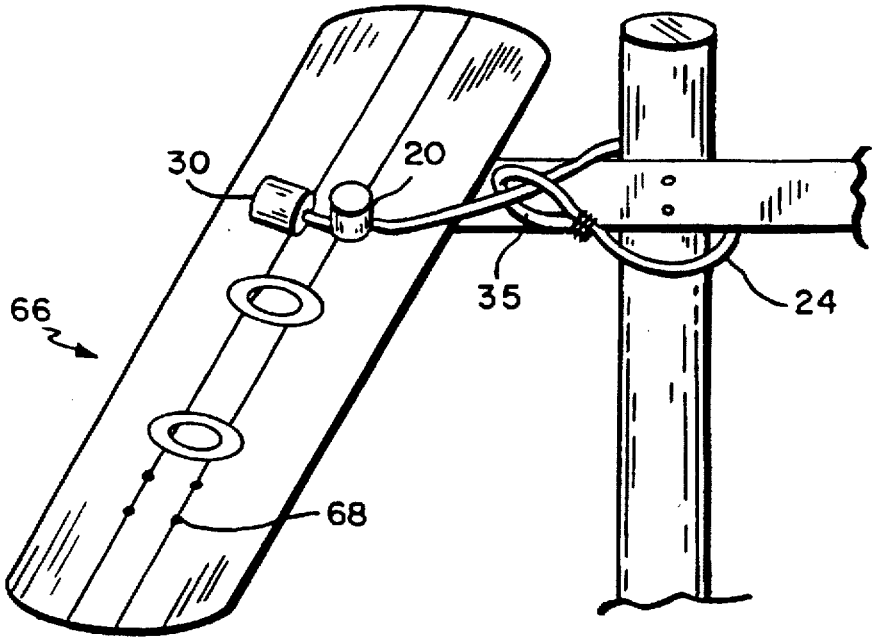
FIG. 5 is a perspective view of a cable lock and attachment assemblage securing a snow board to a fence in accordance with the present invention.

The operation of the attachment and cable lock combination of the present invention is illustrated in FIGS. 4 and 5.

FIG. 4 illustrates a lap top computer 60, which has an internally threaded socket in one of the walls of its housing. In accordance with the present invention, attachment 20 is affixed to this socket in the manner described above. With lock bolt 28 removed from lock body 30, the lock bolt is threaded first through loop 35 to tie cable 24 to the leg of table 64, then through the lateral ports in the shell of attachment 20, and finally into engagement with lock body 30. Lock body 30 is too bulky to slip through the lateral ports of attachment 20.

FIG. 5 illustrates a snow board 66, which has a plurality of internally threaded sockets 68 at its upper face for connection to accessory lacing, boots, etc. In accordance with the present invention, attachment 20 is affixed to an available socket in the manner described above. With lock bolt 28 removed from lock body 30, the lock bolt is threaded first through loop 35 to tie cable 24 to a rail or post, then through the lateral ports in shell 40, and finally into engagement with lock body 30.

Each of these articles is protected from misplacement or misappropriation. The arrangement is such that: the shell is free for swiveling about the collar because of its freedom from the collar's head; the hex notch in the screw head is shielded by the cable when the cable is threaded through the lateral ports in the shell; external access to the collar stem is denied because of the close proximity of the shell to the region surrounding the socket; and swiveling of the shell has no effect on the tight fit between the attachment and the article.

What is claimed is:

1. A security attachment for connection to a portable article, said attachment comprising:

(a) a shell having concentric axial ports and opposed lateral ports;

(b) said concentric ports have different diameters, of which the smaller diameter port is to be positioned contiguously with said portable article and the larger diameter port is to be positioned remotely from said portable article;

(c) a collar within said shell;

(d) said collar being shouldered internally and externally to provide a stem of relatively small internal and external diameter, and a head of relatively large internal and external diameter;

(e) said collar fitting through said larger diameter port;

(f) said collar stem fitting through said smaller diameter port for tight contact with said article;

(g) the axial length of said collar stem being greater than the thickness of said shell in the vicinity of said article;

(h) the interior of said shell including a non-planar surface through which said smaller diameter port extends and which axially faces said collar head, and said collar head being of too great diameter to fit through said smaller diameter port and retaining said shell for free swiveling movement about said collar stem;

(i) a screw having a shank and a head;

(j) said shank being adapted to project through said collar and said smaller diameter port;

(k) said head being adapted to abut against said internal shoulder of said collar;

(l) said head having a central notch configured for reception of a tool.

2. The security attachment of claim 1, wherein said shell is free for swiveling about said collar because of its freedom from said collar head.

3. The security attachment of claim 1, wherein said shell is a spheroid.

4. The security attachment of claim 1, wherein said central notch has a hex shape.

5. The security attachment of claim 1, wherein said shell is composed of steel.

6. The security attachment of claim 1, wherein said collar is composed of steel.

7. The security attachment of claim 1, wherein said screw is composed of steel.

8. A tether lock assembly comprising a security attachment for connection to a movable object, said attachment comprising a tether, a lock and an attachment, said attachment comprising:

(a) a shell having concentric axial ports and opposed lateral ports;

(b) said concentric ports have different diameters, of which the smaller diameter port is to be positioned contiguously with said object and the larger diameter port is to be positioned remotely from said object;

(c) a collar within said shell;

(d) said collar being shouldered internally and externally to provide a collar stem of relatively small internal and external diameter, and a collar head of relatively large internal and external diameter;

(e) said collar fitting through said larger diameter port;

(f) said collar stem fitting through said smaller diameter port for tight contact with said object;

(g) the axial length of said collar stem being greater than the thickness of said shell in the vicinity of said object;

(h) said collar head being of too great diameter to fit through said smaller diameter port and retaining said shell for free swiveling movement about said collar stem;

(i) a screw having a screw shank and a screw head;

(j) said screw shank being adapted to project through said collar and said smaller diameter port;

(k) said screw head being adapted to abut against said internal shoulder of said collar;

(l) said screw head having a central notch configured for reception of a tool;

(m) said tether being threaded through said lateral ports;

(n) said notch of said screw head being directly shielded from tampering by said tether.

9. The tether lock assembly of claim 8, wherein said shell is free for swiveling about said collar because of its freedom from said collar head.

10. The tether lock assembly of claim 8, wherein said shell is a spheroid.

11. The tether lock assembly of claim 8, wherein said central notch has a hex shape.

12. The tether lock assembly of claim 8, wherein said shell is composed of steel.

13. The tether lock assembly of claim 8, wherein said collar is composed of steel.

14. The tether lock assembly of claim 8, wherein said screw is composed of steel.

15. A tether lock assembly comprising a security attachment for connection to a movable object, said attachment comprising a tether, a lock and an attachment, said attachment comprising:

(a) a shell having concentric axial ports and opposed lateral ports;

(b) said concentric ports have different diameters, of which the smaller diameter port is to be positioned contiguously with said object and the larger diameter port is to be positioned remotely from said object;

(c) a collar within said shell;

(d) said collar being shouldered internally and externally to provide a collar stem of relatively small internal and external diameter, and a collar head of relatively large internal and external diameter;

(e) said collar fitting through said larger diameter port;

(f) said collar stem fitting through said smaller diameter port for tight contact with said object;

(g) the axial length of said collar stem being greater than the thickness of said shell in the vicinity of said object;

(h) said collar head being of too great diameter to fit through said smaller diameter port and retaining said shell for free swiveling movement about said collar stem;

(i) a screw having a screw shank and a screw head;

(j) said screw shank being adapted to project through said collar and said smaller diameter port;

(k) said screw head being adapted to abut against said internal shoulder of said collar;

(l) said screw head having a central notch configured for reception of a tool;

(m) said tether being threaded through said lateral ports;

(n) said notch of said screw head being directly shielded from tampering by said tether;

(o) said shell being free for swiveling about said collar because of its freedom from said collar head;

(p) said shell being a spheroid;

(q) said tether being composed of steel strands;

(r) said lock including a lock bolt, a lock body and a key sub-assembly for locking said lock bolt within said lock body;

(s) said lock bolt fitting through said lateral ports of said shell.

* * * * *